US005394576A

United States Patent [19]

Soltani et al.

[11] Patent Number: 5,394,576

[45] Date of Patent: Mar. 7, 1995

[54] PATIENT SUPPORT SYSTEM FASTENING DEVICE AND METHOD

[75] Inventors: Sohrab Soltani, Charleston, S.C.; Edric Kennemer, Wahiawa, Hi.

[73] Assignee: SSI Medical Services, Inc., Charleston, S.C.

[21] Appl. No.: 78,477

[22] Filed: Jun. 15, 1993

[51] Int. Cl.[6] ..... A61G 7/04; A41F 1/00

[52] U.S. Cl. ..... 5/450; 5/453; 5/469; 5/912

[58] Field of Search ..... 5/450, 453, 460, 468, 5/469, 470, 912; 24/587

[56] References Cited

U.S. PATENT DOCUMENTS

| | | | |
|---|---|---|---|
| 2,909,054 | 10/1959 | Phillips . | |
| 3,156,765 | 11/1964 | Weiss . | |
| 3,918,131 | 11/1975 | Ausnit . | |
| 3,987,835 | 10/1976 | Bloomfield . | |
| 4,020,884 | 5/1977 | Jadot | 24/587 X |
| 4,046,408 | 9/1977 | Ausnit . | |
| 4,199,845 | 4/1990 | Ausnit . | |
| 4,354,541 | 10/1982 | Tilman . | |
| 4,498,205 | 11/1985 | Hino | 5/453 X |
| 4,578,813 | 3/1986 | Ausnit . | |
| 4,660,259 | 4/1987 | Ausnit . | |
| 4,673,383 | 6/1987 | Bentsen . | |
| 4,736,496 | 4/1988 | Fisher et al. . | |
| 4,768,250 | 9/1988 | Kato | 5/453 |
| 4,787,880 | 11/1988 | Ausnit . | |
| 4,792,240 | 12/1988 | Ausnit . | |
| 4,812,056 | 3/1989 | Zieke . | |
| 4,846,585 | 7/1989 | Boeckmann et al. . | |
| 4,879,777 | 11/1989 | Goodwin | 5/453 |
| 4,914,760 | 4/1990 | Hargest et al. . | |
| 4,916,767 | 4/1990 | Uetake et al. . | |
| 4,942,635 | 7/1990 | Hargest et al. . | |
| 4,947,525 | 8/1990 | Van Erden . | |
| 4,967,431 | 11/1990 | Hargest et al. . | |
| 5,029,352 | 7/1991 | Hargest et al. . | |
| 5,036,559 | 8/1991 | Hargest . | |
| 5,056,933 | 10/1991 | Kamp . | |
| 5,185,909 | 2/1993 | Inagaki . | |
| 5,187,843 | 2/1993 | Lynch . | |
| 5,293,672 | 3/1994 | Tominaga et al. | 24/587 |

OTHER PUBLICATIONS

"U-MAXIGRIP ® Applications" Brochure.
"U-MAXIGRIP ®" Brochure.
"ULTRASEAL ®"Brochure.
"MAXIGRIP ®" Brochure.

*Primary Examiner*—Michael F. Trettel
*Attorney, Agent, or Firm*—Dority & Manning

[57] ABSTRACT

A fastening device for flexible sheeting members that must be reliably joined at times and easily disengaged at other times is provided along with a method for using same in connection with a patient support system that includes a pressurizable chamber. A male member desirably has two sections formed of relatively softer material. The female member desirably includes a pair of opposed wing members configured so that external pressure exerted against each wing member toward the other wing member has the effect of leveraging the wing members to positively lock the fastening device. A cord closure has a manually operable release mechanism, which is spring biased to engage a cord member anchored at opposite ends to a flexible sheet secured to the fastening device. The operator selects where along the length of the cord member the cord closure is to be engaged to shorten the length of the flexible sheet. In this way, the fastening device can be selectively pulled down below the patient support surface so as not to contact the patient.

21 Claims, 4 Drawing Sheets

PATIENT SUPPORT SYSTEM FASTENING DEVICE AND METHOD

BACKGROUND OF THE INVENTION

The present invention relates to a fastening device, and more particularly to a fastening device for securing together flexible sheeting material of a patient support system and a method employing same.

Specialty patient support systems, such as low air loss beds, air fluidized beds, and hybrid low air loss/air fluidized beds, have provided a significant advancement in patient care. One example of such a bed is disclosed in U.S. Pat. No. 4,942,635 assigned to SSI Medical Services, Inc. Generally, these beds contain various pressurizable chambers, such as individual air sacs and/or a fluidized medium chamber. The air sacs, cover sheets, chambers, etc. defining the support surface are generally formed of flexible sheeting material as is commonly understood in the art. The sheeting material may be air permeable or contain apertures defined therein in a low air loss configuration for the support system. Various conventional means have been utilized to secure the sheeting materials together to define the patient support system. For example, one such fastening device is disclosed in FIG. 5 of U.S. Pat. No. 4,942,635 wherein a fastening device consisting of male and female locking members is disclosed. The male and female members are secured generally to the edges of sheeting material desired to be secured together. For example, the fastening device may be provided to join a cover sheet for a fluidized chamber and an attachment flap extending from an inflatable sac retaining wall, as disclosed in the '635 patent.

However, the conventional fastening devices occasionally separate under certain conditions. If this occurs, the bed must generally be shut down and the patient transferred to another support system. The microspheres may spill out of the bed and into the immediate environment. Additionally, applicants have noted that the conventional fastening devices tend to interfere with the patient's comfort due to their relative disposition on the patient support surface of the system. Moreover, in order to provide additional assurance against separation of conventional fastening devices, fastening devices are configured to provide such powerful locking forces that persons may encounter difficulty in joining and/or separating the fastening devices whenever such manipulation is warranted by the circumstances. Thus, applicants have recognized the desirability of a fastening device that was easily manipulated to join together or separate yet would remain joined more reliably when in service, as well as a fastening device that could be disposed in service in a manner that would not interfere with patient comfort.

OBJECTS AND SUMMARY OF THE INVENTION

It is a principal object of the present invention to provide a patient support system wherein critical fastening devices may be selectively disposed away from the patient support surface of the system.

A still further object of the present invention is to provide patient support systems with a flexible sheeting material fastening device which can be located away from the patient support surfaces.

It is a further principal object of the present invention to improve the reliability of patient support systems by providing a more reliable fastening device therefor.

Another principal object of the present invention is to provide a fastening device that is easily manipulated to join together or separate, yet remains joined more reliably when in service while separating more easily when not in service.

It is yet another object of the present invention to reduce the maintenance and shut down time of patient support systems by providing a more reliable fastening device therefor.

Yet a further object of the present invention is to provide an improved fastening device for securing together flexible sheeting material of a patient support system.

Another principal object of the present invention is to provide an improved fastening device for use with flexible sheeting material in general.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims. To achieve the objects and in accordance with the purpose of the invention, as embodied and broadly described herein, the present invention pertains to any patient support system that includes a pressurizable chamber which is formed at least in part by flexible sheeting members that must be reliably joined at times and easily disengaged at other times. A pressurizable chamber is defined by a diffuser board, a flexible sheet, an inflatable wall, a filter sheet, and a tank side wall. A mass of fluidizable material such as microspheres is carried on top of the diffuser board and laterally retained above the diffuser board at least partly by the flexible sheet and the filter sheet. One edge of the flexible sheet is anchored to the diffuser board by a metal plate.

In accordance with the present invention, a means is provided for fastening together at least one predetermined section of one flexible sheet to at least one predetermined section of another flexible sheet. While the fastening means can include a conventional extruded plastic zipper fastener, the present invention desirably includes an improved fastening device for securing together flexible sheeting material of a patient support system. As embodied herein, the fastening means can include a male member having a substantially uniform cross-sectional profile along substantially the entire length thereof. The male member includes a head portion and a stem portion defined below the head portion. The stem portion is configured to be secured to a flexible sheet such as either the flexible retaining panel that keeps the microspheres above the diffuser board or the filter sheet that rests on top of the microspheres. The cross-sectional profile of male head portion can define a semi-circular circumferential shape and can include a pair of oppositely disposed rear barbs. Each rear barb cooperates with an opposing side of the stem portion 63 to define a recess.

In a preferred embodiment, two sections of the male head portion are formed of a softer material than the remainder of the male member. Each of the softer sections is disposed along one side of the head portion. In an embodiment in which the softer sections of the male member have a durometer of approximately 60 Shore A, the remainder of the male member desirably would be provided with material having a durometer of approximately 80 Shore A.

The preferred fastening means of the present invention desirably includes a female member which has a substantially uniform cross-sectional profile along substantially the entire length thereof. The female member includes a receiving pocket that is configured to receive the head portion of the male member and has an entrance. The female member includes a stem portion which is configured to be secured to a sheet of material in much the same fashion as the stem member of the male member. The female member can include a pair of forward barb portions that extend into the receiving pocket. Each forward barb portion is configured to fit in a corresponding one of the recesses of the head portion of the male member. Each forward barb cooperates with an opposing side of the wall surface which forms the receiving pocket to define a recess. The female member is formed of a material that resiliently maintains its shape and has a durometer of about 80 Shore A. Accordingly, when the head portion of the male member is inserted through the entrance into the receiving pocket, the receiving pocket conforms to the corresponding shape of the head portion, and the forward barb portions positively lock within the recesses and against the rear barb portions. Moreover, the softer sections of the head portion facilitate insertion of the head portion of the male member past the entrance and into the receiving pocket of the female member.

In a preferred embodiment, the female member desirably includes a pair of opposed wing members. Each wing member is configured to extend from the entrance at an angle so as to diverge away from the entrance and away from the other opposed wing member. External pressure exerted against each wing member toward the other wing member has the effect of leveraging the wing members to positively narrow the entrance of the receiving pocket.

In further accordance with the present invention, a means is provided to permit an operator to selectively dispose a fastening device away from the patient supporting surface of the patient support system. Desirably, a means of pulling the fastening device down into the mass of fluidizable material sufficiently to sink the fastening device beneath the patient supporting surface is provided. The so-called pull-down means can include at least one cord member and a means for slidably engaging the cord member. The cord engaging means can be secured to the flexible wall of the patient support system and can include a first grommet flap secured to the flexible sheet in the vicinity of a free edge of the flexible sheet. A first grommet can be secured in the first grommet flap. The cord engaging means can also include a second grommet flap secured to the flexible sheet and disposed to be spaced apart from the first grommet flap. A second grommet can be secured in the second grommet flap and disposed substantially in registry with the first grommet. A first anchoring member can be provided in the form of a knot that prevents passage one end of the cord member through one of the grommets. A second anchoring member can include a cord closure which selectively engages the cord member through an opening in the main body portion of the cord closure. The cord closure has a manually operable release mechanism, which is spring biased to engage the cord member and permits the operator to select where along the length of the cord member the cord closure is to be engaged.

In operation, the head portion of the male member is inserted between the wing members of the female member and moved toward the entrance of the receiving pocket. In the course of this movement, the softer sections of the head portion deform and the wing members move apart to leverage the enlargement of the entrance to allow passage thereby of the head portion of the male member. The receiving pocket receives the head portion and the forward barbs nest within the recesses adjacent the rear barbs, and the rear barbs nest within the recesses adjacent the forward barbs.

In further accordance with the present invention, a method is provided of disposing the fastening means for the filter sheet in a manner that avoids patient contact with same. The method involves securing the filter sheet to a flexible sheet. While this can be achieved with a conventional fastening device, it is desirably done with a fastening means that responds to pressure by increasing the positive locking force of the fastening means. Thus, the securing step desirably can be accomplished with a fastening device with wing members that narrow the entrance as external pressure is applied to move the wing members toward one another. The method further includes the step of shortening the extension of the flexible sheet until the fastening means is disposed a predetermined distance beneath the patient support surface. The shortening step can be accomplished as shown by pulling a length of cord, which is anchored at a first grommet, toward a second grommet anchored by a knot at a predetermined distance from the first grommet. As the cord is pulled, one grommet is moved closer to the other grommet, thereby shortening the extension of the flexible member between the two grommets and disposing the fastening device a predetermined distance beneath the patient support surface.

In further accordance with the method of the present invention, the fastening means can be secured beneath the patient support surface. The fastening device is secured beneath the patient support surface by a selectively engageable cord closure. The cord closure is selectively engaged by a release mechanism, which can be depressed in order to allow the cord closure to slide along the length of the cord member. When the release mechanism is not being manually depressed, the spring loaded cord closure engages the cord member and prevents both the lengthening and shortening of the distance along the flexible sheet extending between the first and second grommets.

When it is desired to disengage the fastening device in order to separate the filter sheet from the flexible sheet, the operator merely reaches down and depresses the release mechanism of the cord closure and pulls upwardly to slide one of the grommets along the cord away from the other grommet and extend the length of the flexible sheet until the fastening device is pulled above the level of the support surface. Then the wing members can be pulled apart from one another while simultaneously pulling the male member away from the female member to disengage each from the other.

The accompanying drawings which are incorporated in and constitute a part of the specification, illustrate at least one preferred embodiment of the invention and, together with the description, serve to explain the principles of the invention.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

Figure 1:
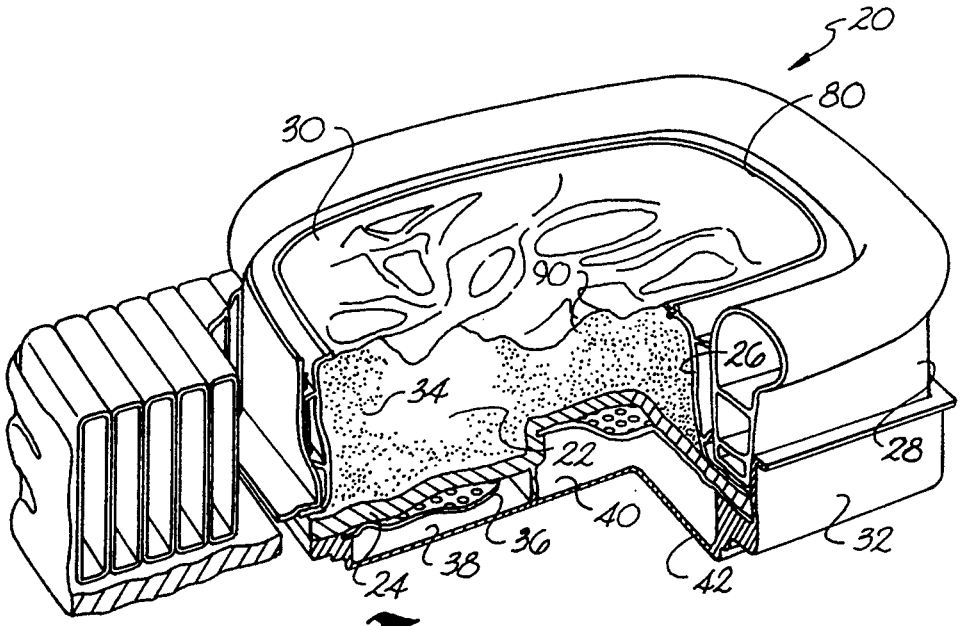
FIG. 1 shows an elevated perspective view with portions cut away to reveal a preferred embodiment of the present invention.
Figure 2:
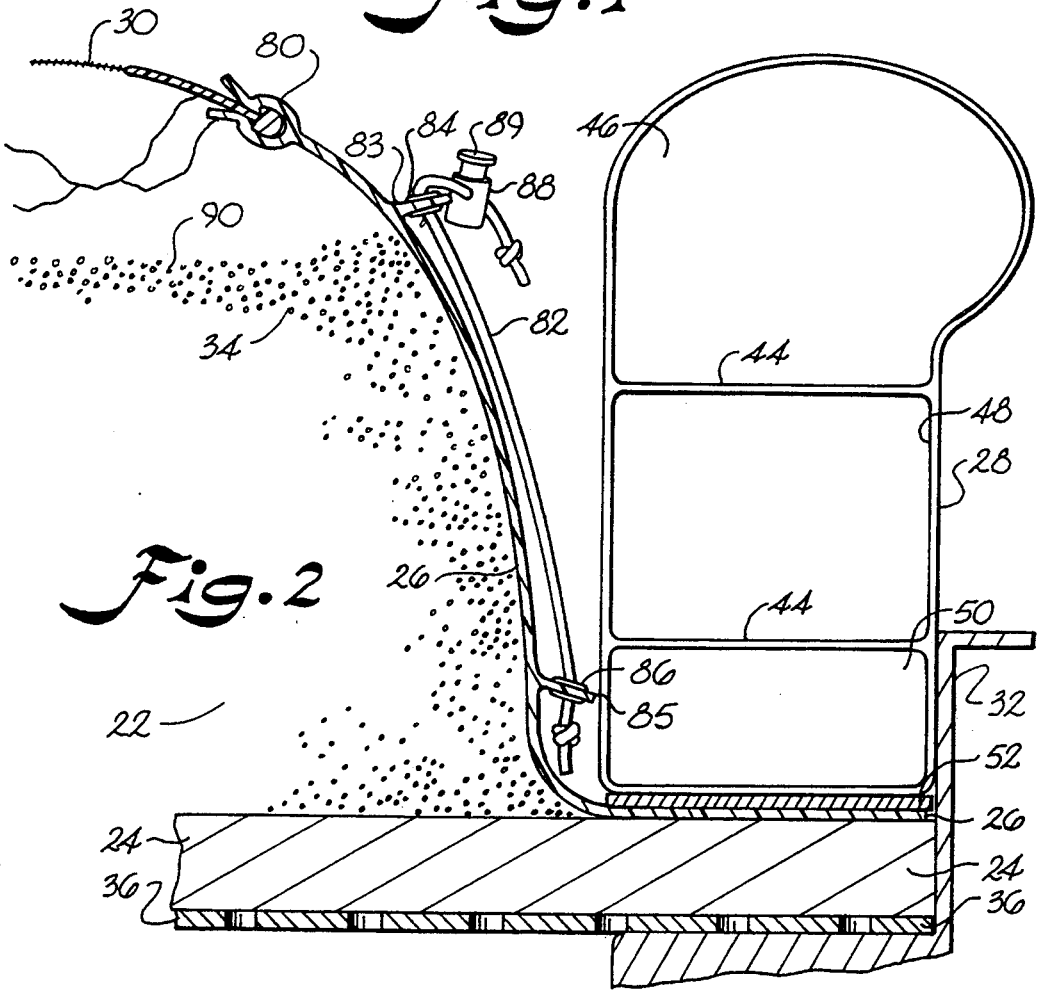
FIG. 2 shows a partial cross-sectional view of portions exposed by removal of one of the cut-away portions shown in FIG. 1.
Figure 3:
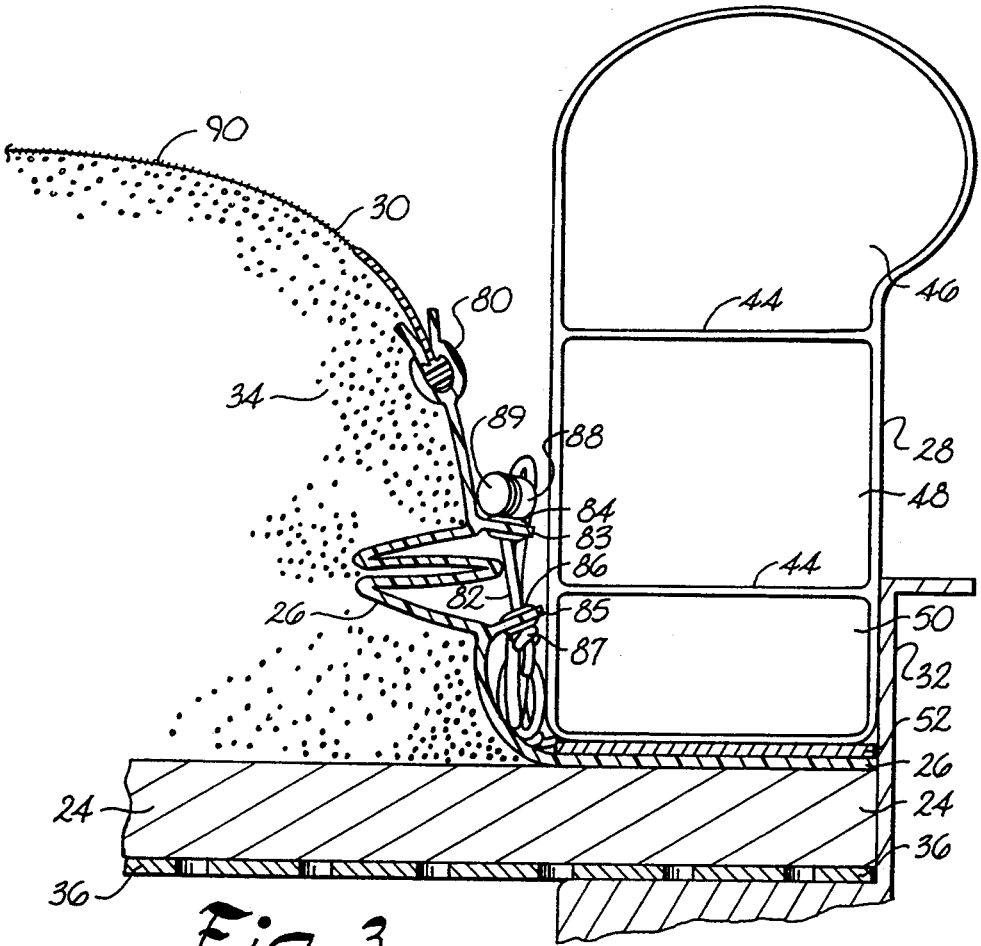
FIG. 3 shows a partial cross-sectional view of portions exposed by removal of one of the cut-away portions shown in FIG. 1.
Figure 8:
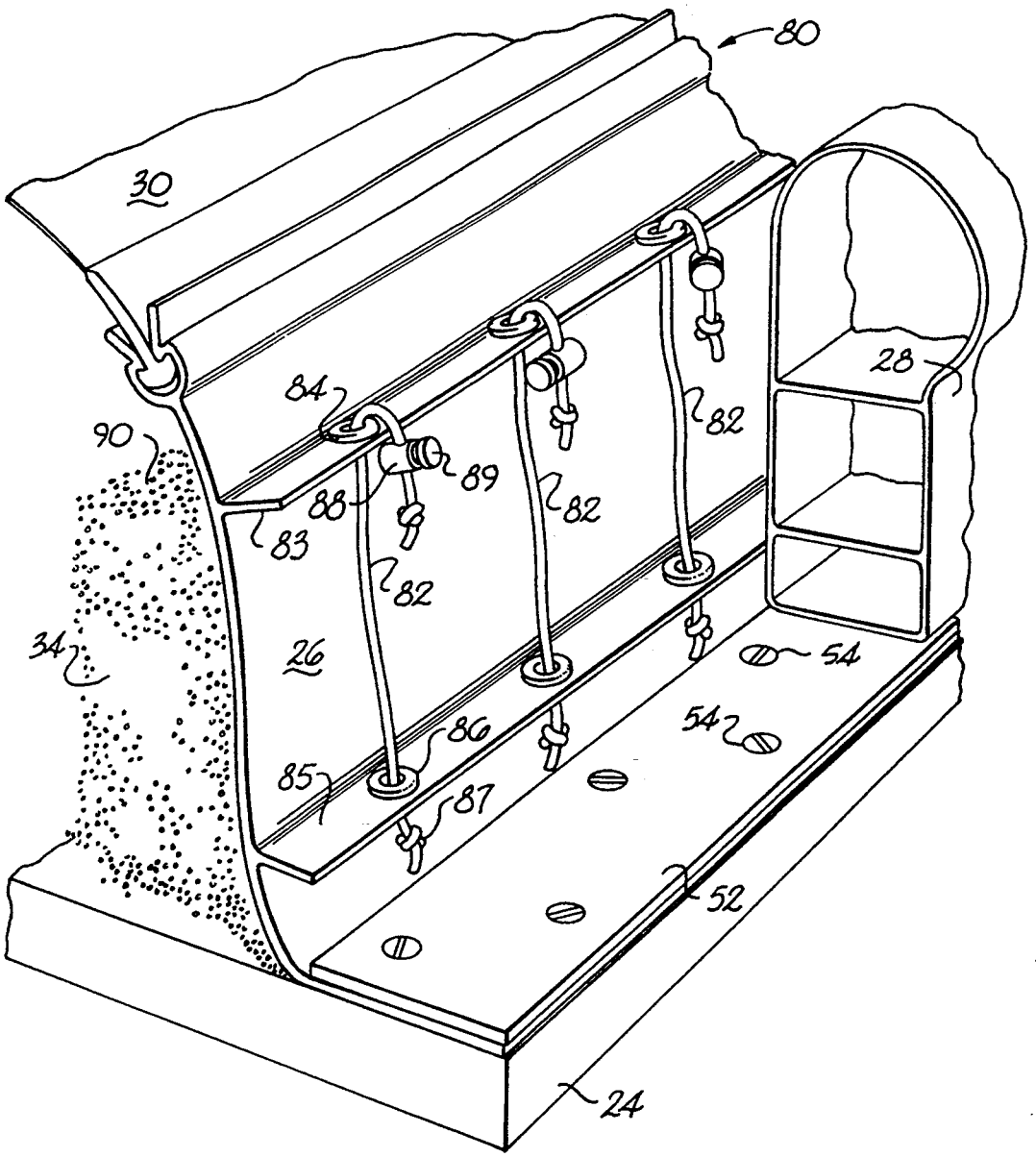
FIG. 8 shows an elevated perspective view with portions cut away to reveal components of a preferred embodiment of the present invention.

A preferred embodiment of the present invention is shown in FIG. 1 and is represented generally by the numeral 20. Only the patient supporting portion of patient support system 20 is illustrated in FIG. 1 in order to facilitate explanation of the present invention, which primarily is directed to a patient support system that includes a pressurizable chamber which is formed at least in part by flexible sheeting members that must be reliably joined at times and easily disengaged at other times. As shown in FIG. 1, a pressurizable chamber 22 is defined by a diffuser board 24, a flexible sheet 26, an inflatable wall 28, a filter sheet 30, and a tank side wall 32. A mass of fluidizable material such as microspheres 34 is carried on top of diffuser board 24 and laterally retained above diffuser board 24 at least partly by flexible sheet 26 and filter sheet 30. Diffuser boards 24 are provided with support by metal perforated plates 36, and a pair of plenum chambers 38, 40 are formed between tank bottom wall 42 and plates 36. As shown in FIG. 2, for example, inflatable wall 28 may be provided with one or more internal webs 44 which divide wall 28 into separately pressurizable compartments 46, 48, 50. As shown in FIGS. 2, 3 and 8 for example, one edge of flexible sheet 26 is anchored to diffuser board 24 by a metal plate 52 which can be bolted into diffuser board 24 by a plurality of screws 54. Additional details of air fluidized beds can be learned from one or more of U.S. Pat. Nos. 4,914,760, 4,942,635, 4,967,431, and 5,029,352, 5,036,559, each of which is hereby incorporated herein by this reference.

Figure 4:
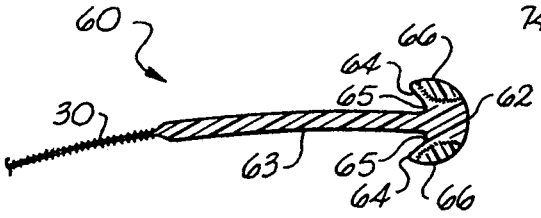
FIG. 4 shows a cross-sectional view of a component of a preferred embodiment of the present invention.
Figure 5:
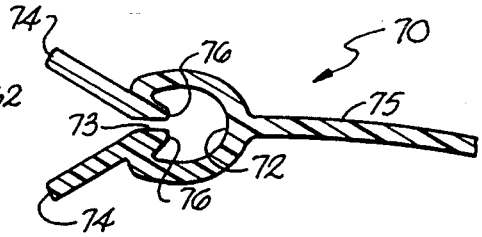
FIG. 5 shows a cross-sectional view of a component of a preferred embodiment of the present invention.

In accordance with the present invention, a means is provided for fastening together at least one predetermined section of one flexible sheet to at least one predetermined section of another flexible sheet. For example, the fastening means can be a conventional fastening device such as shown in FIG. 5 of one of the above patents incorporated herein by reference. However, while the fastening means can include a conventional extruded plastic zipper fastener, the present invention desirably includes an improved fastening device for securing together flexible sheeting material of a patient support system. Accordingly, in a preferred embodiment of the present invention and as embodied herein and shown in FIGS. 4, 6, and 7, the fastening means can include a male member generally designated by the numeral 60. As shown in FIGS. 5 and 7, male member 60 can have a substantially uniform cross-sectional profile along substantially the entire length thereof. Male member 60 can include a head portion 62 and a stem portion 63 defined below head portion 62. Stem portion 63 is configured to be secured to a flexible sheet such as either flexible sheet 26 or filter sheet 30. In FIG. 4 for example, stem portion is secured to filter sheet 30, but just as easily could be secured to flexible sheet 26. The cross-sectional profile of male head portion 62 can define a barbed arrow with a generally semi-circular circumferential shape instead of a pointed acute angular shape as in a conventional arrow shape. Thus, the forwardmost portion of head portion 62 is curved rather than pointed. As shown in FIGS. 4 and 7, the cross-sectional profile of male head portion 62 can include a pair of oppositely disposed rear barbs 64. Each rear barb 64 cooperates with an opposing side of stem portion 63 to define a recess 65.

In a preferred embodiment shown in FIG. 4 for example, two sections 66 of male head portion are formed of a softer material than the remainder of male member 60. Each of the softer sections 66 is disposed along one opposite side of head portion 62. In an embodiment in which the softer section 66 male member 60 have a durometer of approximately 60 Shore A, the remainder of male member 60 desirably would be provided with material having a durometer of approximately 80 Shore A.

Figure 6:
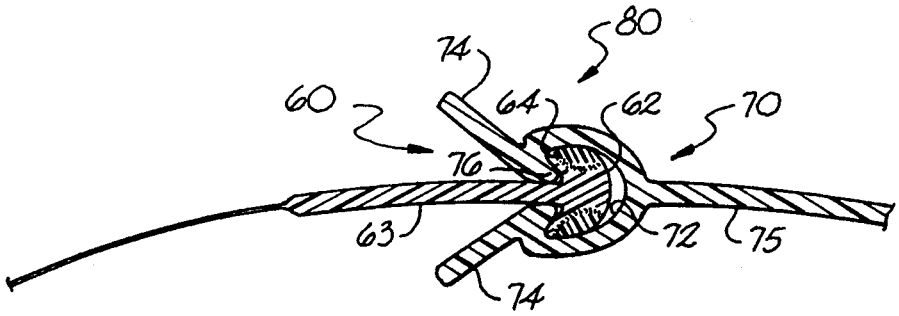
FIG. 6 shows a cross-sectional view of components of a preferred embodiment of the present invention.
Figure 7:
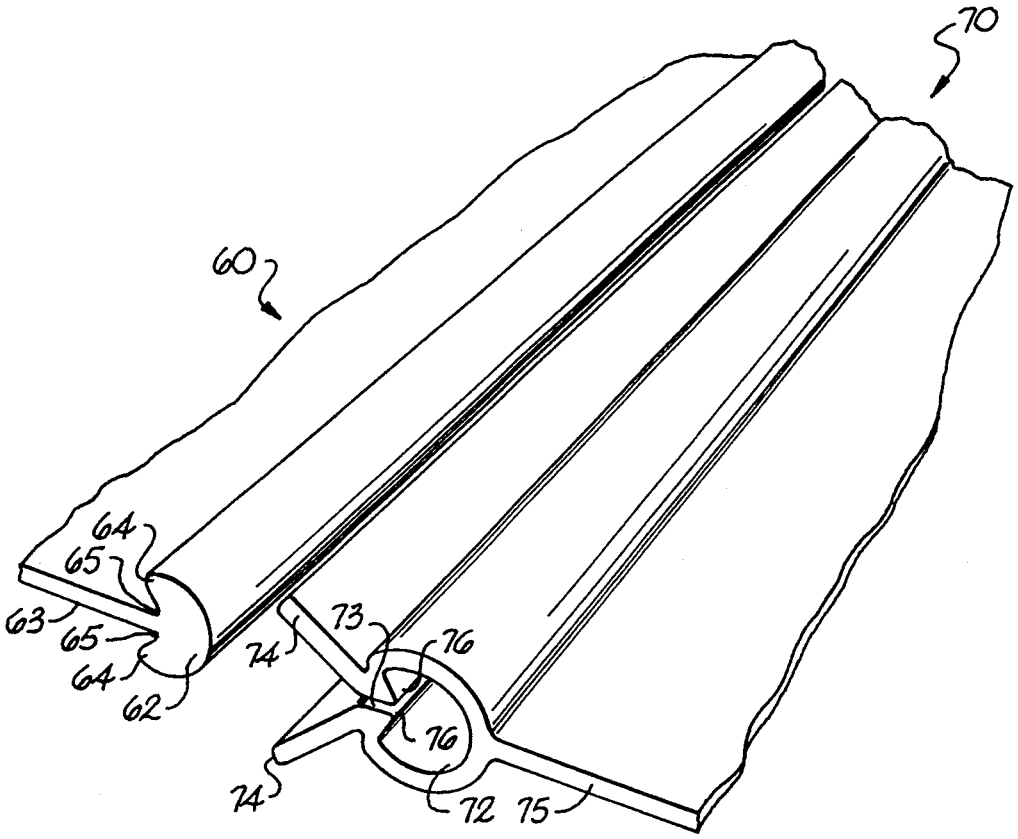
FIG. 7 shows a elevated perspective view of components of a preferred embodiment of the present invention.

As shown in FIGS. 5–7, a preferred embodiment of the fastening means can include a female member indicated generally by the numeral 70. As shown in FIGS. 5 and 7, female member 70 can have a substantially uniform cross-sectional profile along substantially the entire length thereof. Female member 70 can include a receiving pocket 72 that is configured to receive male member head portion 62. The receiving pocket 72 within the female member 70 and the male member head portion 62 have generally complementary configurations. Receiving pocket 72 can be configured with an entrance 73. Female member 70 includes a stem portion 75 which is configured to be secured to a sheet of material such as filter sheet 30 or flexible retaining sheet 26. As shown in FIGS. 5 and 7, female member 70 can include a pair of forward barb portions 76 that extend into receiving pocket 72. Each forward barb portion 76 desirably is configured to correspond with a corresponding one of recesses 65 of head portion 62 of male member 60. Each forward barb 76 desirably cooperates with an opposing side of the wall surface which forms receiving pocket 72 to define a recess 77. Female member 70 is formed of a material that resiliently maintains its shape and has a durometer of about 80 Shore A. Accordingly, when head portion 62 of male member 60 is inserted through entrance 73 into receiving pocket 72, receiving pocket 72 conforms to the corresponding shape of head portion 62, and forward barb portions 76 positively lock within recesses 65 and against rear barb portions 64. Moreover, the softer sections 66 of head portion 62 facilitate insertion of head portion 62 of male member 60 past entrance 73 and into receiving pocket 72 of female member 70.

In a preferred embodiment, female member 70 desirably includes a pair of opposed wing members 74. Each wing member 74 is configured to extend from entrance 73 at an angle so as to diverge away from entrance 73 and away from the other opposed wing member 74. External pressure exerted against each wing member 74 toward the other wing member 74 has the effect of leveraging wing members 74 to positively narrow entrance 73 of receiving pocket 72. In this manner, external pressure applied against the wing members 74 causes the wing members to squeeze the entrance 73 of the receiving pocket 72 to prevent the head portion 62 of male member 60 from being withdrawn from the pocket, thus ensuring reliability of the fastening device. Manually pulling apart wing members 74 expands the entrance of pocket 72 to facilitate manual withdrawal of head portion 62 from receiving pocket 72.

In still another preferred embodiment of the invention, the improved fastening device (indicated generally in FIGS. 1–3, 6 and 8 of the present application by the numeral 80) may be provided without the wing members 74 extending from the entrance 73 of the female member 70. In this latter embodiment, the male member head portion 62 includes at least one section 66 defined therein along substantially the length thereof formed of a material having a lesser hardness than the material forming the female member 70. Alternatively, the wing members 74 may also be provided in an embodiment in which the male member head portion 62 includes at least one section 66 defined therein along substantially the length thereof formed of a material having a lesser hardness than the material forming the female member 70.

In accordance with the objects and purposes of the invention, the improved fastening device 80 can be configured to secure any manner of flexible sheeting material of a patient support system. For example, in one preferred embodiment, the fastening device 80 may be configured to join together a cover sheet 30 of a pressurizable chamber 22 containing a fluidizable medium, such as microspheres or beads 34, to the retaining sheet 26 between the beads 34 and pressurizable side walls 28 defining the chamber 22 or to a retaining sac or wall. In another embodiment, the fastening device 80 may be provided to join together the walls of a fluidizable medium chamber 22 to a patient supporting inflatable sac. In another embodiment, the fastening device 80 may be configured to join together a plurality of adjacently disposed inflatable sacs of the patient support system. The inflatable sacs may be low air loss sacs, for example.

In operation of an illustrative embodiment, the respective stem portions 63, 75 of male member 60 and female member 70 are secured to either filter sheet 30 or flexible sheet 26 in any conventional manner such as RF welding for example. Filter sheet 30 is permeable to the passage of air therethrough but not permeable to the passage of microspheres 34 therethrough. Flexible sheet 26 is impermeable both to the passage of air and the passage of microspheres 34. In the embodiment illustrated in the FIGS., as shown in FIGS. 6 and 7, head portion 62 of male member 60 is inserted between wing members 74 of female member 70 and moved toward entrance 73 of receiving pocket 72. In the course of this movement, softer sections 66 deform and wing members 74 move apart to leverage the enlargement of entrance 73 to allow passage thereby of head portion 62 of male member 60. As shown in FIG. 6, receiving pocket 72 receives head portion 62 and forward barbs 76 nest within recesses 65 adjacent rear barbs 64, and rear barbs nest within recesses 77 adjacent forward barbs 76. As shown in FIGS. 1, 2 and 8, fastening device 80 is disposed above the patient support surface 90 formed by microspheres 34. Since fastening device 80 is substantially formed of material with a durometer of 80 Shore A, patient contact with fastening device 80 might discomfort the patient.

In further accordance with the patient support system of the present invention, a means is provided to permit an operator to selectively dispose a fastening device away from the patient supporting surface of the patient support system. Desirably, a means of pulling the fastening device down into the mass of fluidizable material sufficiently to sink the fastening device beneath the patient supporting surface is provided. The fastening device in this aspect of the present invention can be any means for fastening together at least one predetermined section of the flexible sheet to at least one predetermined section of the filter sheet to form a pressurizable chamber for fluidizing microspheres of the patient support system. For example, the fastening device can be a conventional device such as shown in FIG. 5 of one of the above patents incorporated herein by reference or can be a device such as indicated generally in FIGS. 1–3, 6 and 8 of the present application by the numeral 80.

As embodied herein and shown in FIGS. 2, 3 and 8 for example, the so-called pull-down means includes at least one cord member 82 and a means for slidably engaging the cord member 82. The cord engaging means desirably is secured to the flexible wall 26 of the patient support system. As shown in FIG. 8 for example, the engaging means for each cord member desirably includes a first grommet flap 83 secured to flexible sheet 26 in the vicinity of a free edge of flexible sheet 26. A first grommet 84 is secured in first grommet flap 83. The cord engaging means further desirably includes a second grommet flap 85 secured to flexible sheet 26 and disposed to be spaced apart from first grommet flap 83. A second grommet 86 is secured in second grommet flap 85 and disposed substantially in registry with first grommet 84. As shown in FIG. 8, a first anchoring member is provided in the form of a knot 87 at one end of cord member 82 and sized and configured to prevent passage of knot 87 through one of the grommets, in this case grommet 86. A second anchoring member is selectively engageable to cord member 82. As shown in FIG. 8, the second anchoring member can include a selectively engageable cord closure 88. A suitable embodiment of cord closure 88 is available from FASTEX of Des Plaines, Ill. 60016 under the name BARRELOC™. Cord closure 88 is disposed to receive the other end of cord member 82 through an opening in the main body portion of cord closure 88. Cord closure 88 desirably includes a release mechanism 89, which is spring biased to allow the operator to selectively engage cord member 82. Manual depressing of the spring-biased release mechanism 89 permits cord closure 88 to be slid along the length of cord member 82 as the operator selects.

In further accordance with the present invention, a method is provided of disposing the fastening means for the filter sheet in a manner that avoids patient contact with the fastening means. As embodied herein, one step of the method can employ a conventional, extruded plastic zipper fastener to secure at least predetermined portions of the filter sheet to at least predetermined portions of the flexible sheet. However, the method desirably can involve securing the filter sheet to a flexible sheet with a fastening means that responds to pressure that is externally applied to the fastening means, by increasing the positive locking force of the fastening means. As explained above, a preferred embodiment of fastening device 80 includes wing members 74 to respond to external pressure applied to the wing members towards one another in a manner that tends to narrow entrance 73 and maintain positive locking action between rear barbs 64, forward barbs 76, and recesses 65, 77.

As shown in FIG. 3, the method further includes the step of shortening the extension of the flexible sheet until the fastening means is disposed a predetermined distance beneath the patient support surface. The shortening step can be accomplished as shown in FIG. 3 by pulling a length of cord 82, which is anchored at a first grommet 84, toward a second grommet 86 anchored by a knot 87. Each grommet 84, 86 is separately attached to flexible sheet 26 at a predetermined distance from one another. As cord 82 is pulled, one grommet 84 is moved closer to the other grommet 86, thereby shortening the extension of flexible member 26 between the two grommets 84, 86. As shown in FIG. 3, upon shortening the extension of flexible sheet 26, the fastening device 80 is disposed a predetermined distance beneath the patient support surface 90.

In further accordance with the method of the present invention, the fastening means can be secured beneath the patient support surface. As shown in FIG. 3 for example, fastening device 80 is secured beneath patient support surface 90 by a selectively engageable cord closure 88. A release mechanism 89 can be depressed in order to allow cord closure 88 to slide along the length of cord member 82. When release mechanism 89 is not being manually depressed, the spring loaded cord closure 88 engages the cord member 82 and prevents the extension of the distance between first and second grommets 84, 86.

When it is desired to disengage the fastening device 80 in order to separate filter sheet 30 from flexible sheet 26, the operator merely reaches down and depresses release mechanism 89 of cord closure 88 and pulls upwardly to slide one of the grommets 84 along cord 82 away from the other grommet 86 and extend the length of flexible sheet 26 until fastening device 80 is pulled above the level of the support surface 90. Then wing members 74 can be pulled apart from one another while simultaneously pulling male member 60 away from female member 70 to disengage each from the other.

In order to facilitate illustration of various components of the present invention, the illustrations of FIGS. 1–3 and 8 depart from reality in one respect. Because of the weight of the microspheres 34, the flexible sheet 26 and associated components, including the cord 82, the locking mechanism 80, and the grommet flaps 83, 85, would be pressed flush against the inside surface of the inflatable elastic wall 28. The wing members 74 would be pressed together between the mass of microspheres 34 and the pressurized elastic wall 28. The actual disposition of the wing members 74 beneath the surface of the mass of fluidizable material 34 and against the inner surface of the pressurizable elastic wall 28 would tend to squeeze the opposed wing members 74 toward one another to narrow the entrance to the pocket 72 and thereby reduce the likelihood of any separation between the male head portion 62 and female pocket portion 72 of the fastening device 80 of the present invention.

What is claimed is:

1. A patient support system, comprising:

a tank;

a diffuser board carried by said tank;

a mass of fluidizable material disposed on said diffuser board;

a first flexible sheet configured and disposed to retain said fluidizable material above said diffuser board in the form of a patient support surface;

a filter sheet disposed above said fluidizable material;

a means for fastening together at least one predetermined section of said flexible sheet to at least one predetermined section of said filter sheet to form a pressurizable chamber; and a pull-down means for selectively disposing said fastening means by an operator away from said patient support surface.

2. A system as in claim 1, wherein said pull-down means includes at least one cord member secured to said fastening means.

3. A system as in claim 2, wherein said pull-down means further includes a first anchoring member disposed at one end of said cord member and a second anchoring member selectively disposable at the other end of said cord member.

4. A system as in claim 1, wherein said fastening means includes:

a male member having a substantially uniform cross-sectional profile along substantially the length thereof, said male member including a head portion and a stem portion defined below said head portion, said stem portion being configured to be secured to one of said flexible sheet and said filter sheet; and a female member having a substantially uniform cross-sectional profile along substantially the length thereof, said female member including a receiving pocket configured to receive said male member head portion, said pocket being configured with an entrance into said pocket, said female member including a pair of opposed wing members, each said wing member being configured to extend from said entrance at an angle so as to diverge from said entrance and from said other wing member, whereby external pressure exerted against said wing members leverages said wing members to positively narrow said entrance of said pocket, said female member including a stem portion configured for being secured to the other of said flexible sheet and said filter sheet.

5. A method of disposing the fastening means for the filter sheet of an air fluidized patient support surface, the method comprising the steps of:

securing the filter sheet to a flexible sheet with a fastening means;

shortening the extension of said flexible sheet until said fastening means is disposed a predetermined distance beneath the patient support surface; and securing said fastening means beneath the patient support surface.

6. The method as in claim 5, wherein said filter sheet securing step includes using a fastening means that responds to pressure by increasing the positive locking force of the fastening means.

7. The method as in claim 6, wherein said filter sheet securing step includes:

inserting the head portion of a male member having a stem portion secured to one of said flexible sheet and said filter sheet, into the receiving pocket of a female member including a stem portion secured to the other of said flexible sheet and said filter sheet and having a pair of opposed wing members, each said wing member being configured to extend from the entrance of the receiving pocket at an angle so as to diverge from said entrance and from said other wing member, whereby external pressure exerted against said wing members leverages said wing members to positively narrow said entrance of said pocket.

8. The method as in claim 5, wherein said flexible sheet shortening step includes:

pulling a length of cord anchored at a first grommet, through a second grommet, each grommet being separately attached to said flexible sheet at a predetermined distance from said other grommet, said pulling of the cord thereby shortening the extension of said flexible member as one grommet is drawn toward the other grommet.

9. The method as in claim 8, wherein said fastening means securing step includes:

when said flexible sheet is sufficiently shortened to dispose said fastening means at said predetermined distance beneath said patient support surface, then clamping the unanchored end of said cord adjacent to said second grommet.

10. An improved fastening device for securing together flexible sheets of material defining at least one pressurizable chamber of a patient support system, the fastening device comprising:

a male member having a substantially uniform cross-sectional profile along substantially the length thereof, said male member including a head portion and a stem portion defined below said head portion, said stem portion being configured to be secured to one sheet of material; and a female member having a substantially uniform cross-sectional profile along substantially the length thereof, said female member including a receiving pocket configured to receive said male member head portion, said pocket being configured with an entrance into said pocket, said female member including a pair of opposed wing members, each said wing member being configured to extend from said entrance at an angle so as to diverge from said entrance and from said other wing member, whereby external pressure exerted against said wing members leverages said wing members to positively narrow said entrance of said pocket, said female member including a stem portion configured for being secured to another sheet of material.

11. The fastening device as in claim 10, wherein:

the cross-sectional profile of said male head portion defines a barbed arrow with a generally semi-circular circumferential shape instead of a pointed acute angular shape as in a conventional arrow shape, the cross-sectional profile of said male head portion includes a pair of oppositely disposed rear barbs, each said rear barb and an opposite side of said stem portion combining to define a recess, each said wing member including a forward barb portion extending into said pocket for locking engagement with a corresponding one of said recesses, whereby external pressure exerted against said wing members causes said forward barb portions to positively lock within said recesses and against said rear barb portions.

12. The fastening device as in claim 11, wherein said male member is partially formed of a first material of predetermined hardness, said male member head portion further defining at least one section formed of a second material, said second material being softer than said first material.

13. The fastening device as in claim 12, wherein said female member is formed of said first material having a hardness value of approximately 80 durometer Shore A, said second material having a hardness value of approximately 60 durometer Shore A.

14. The fastening device as in claim 13, wherein said stem portion of one of said male and female members is joined to a first sheet of material that at least partially defines at least one pressurizable chamber of the patient support system and said stem portion of the other of said male and female members is joined to a second sheet of material that at least partially defines said at least one pressurizable chamber of the patient support system.

15. The fastening device as in claim 14, further comprising a pull-down means for selectively disposing said male and female members by an operator away from the patient supporting surface of the patient support system.

16. The fastening device as in claim 15, wherein said pull-down means includes at least one cord member connected to at least one of said female member and said male member.

17. The fastening device as in claim 16, wherein said pull-down means further includes a means for slidably engaging said cord member, said cord engaging means being secured to said flexible wall.

18. The fastening device as in claim 17, wherein said pull-down means further includes a first anchoring member disposed at one end of said cord member and configured to anchor said cord member to said cord engaging means, said pull-down means further including a second anchoring member selectively disposable at the other end of said cord member to selectively anchor said cord member to said cord engaging means.

19. The fastening device as in claim 18, wherein:

said cord engaging means includes a first grommet flap secured to said flexible sheet near a free edge thereof and a first grommet secured in said first grommet flap, said cord engaging means further including a second grommet flap secured to said flexible sheet and spaced apart from said first grommet flap, said cord engaging means further including a second grommet secured in said second grommet flap and disposed substantially in registry with said first grommet; and said first anchoring member includes a knot at one end of said cord member and configured to prevent passage of said knot through one of said grommets, said second anchoring member including a selectively engagable cord closure disposed to receive said other end of said cord member to selectively anchor said cord member in the vicinity of said other of said first and second grommets.

20. An improved fastening device for securing together flexible sheets of material defining at least one pressurizable chamber of a patient support system, the fastening device comprising:

a male member having a substantially uniform cross-sectional profile along substantially the length thereof, said male member including a head portion and a stem portion defined below said head portion, said stem portion being configured to be secured to one sheet of material, wherein said male member is partially formed of a first material of predetermined hardness, said male member head portion further defining at least one section formed of a second material, said second material being softer than said first material; and a female member having a substantially uniform cross-sectional profile along substantially the length thereof, said female member including a receiving pocket configured to receive said male member head portion, said pocket being configured with an entrance into said pocket, said female member including a stem portion configured for being secured to another sheet of material.

21. The fastening device as in claim 20, wherein:

said male member head portion comprises two said sections of softer material, one of said two softer sections being disposed generally along one side of said head portion, the other of said two softer sections being disposed generally along the other side of said head portion, the cross-sectional profile of said male head portion includes a pair of oppositely disposed rear barbs, each said rear barb and an opposite side of said stem portion combining to define a recess, and said entrance including a pair of forward barb portions extending into said pocket for locking engagement with said recesses and against said rear barb portions.

* * * * *